US005558562A

United States Patent [19]

Diat

[11] Patent Number: 5,558,562

[45] Date of Patent: Sep. 24, 1996

[54] METHOD FOR MICRO-CLEANING A SUPPORT AND APPARATUS FOR IMPLEMENTING SAME

[76] Inventor: Christian Diat, 5, Allée des Chataigniers -Résidence La Bretonnière, 44360 Vigneux-de-Bretagne, France

[21] Appl. No.: 244,787

[22] PCT Filed: Dec. 11, 1992

[86] PCT No.: PCT/FR92/01177

§ 371 Date: Jun. 9, 1994

§ 102(e) Date: Jun. 9, 1994

[87] PCT Pub. No.: WO93/11908

PCT Pub. Date: Jun. 24, 1993

[30] Foreign Application Priority Data

Dec. 11, 1991 [FR] France ..... 91 15567
Dec. 11, 1991 [FR] France ..... 91 15568

[51] Int. Cl.[6] ..... B24B 1/00

[52] U.S. Cl. ..... 451/38; 451/75; 451/90; 451/101; 451/39

[58] Field of Search ..... 451/75, 90, 39, 451/40, 91, 101, 102, 99, 32, 38

[56] References Cited

U.S. PATENT DOCUMENTS

| | | |
|---|---|---|
| 1,944,404 | 1/1934 | Coble et al. . |
| 1,951,627 | 3/1934 | Pelk . |
| 2,605,596 | 8/1952 | Uhri . |
| 2,644,275 | 7/1953 | Hoguet . |
| 2,669,809 | 2/1954 | McGrath . |
| 2,755,598 | 7/1956 | Van Denburgh . |
| 2,900,851 | 8/1959 | Rutledge . |
| 3,561,163 | 2/1971 | Arnold . |
| 4,045,915 | 9/1977 | Gilbert et al. . |
| 4,112,535 | 9/1978 | Wild et al. . |
| 4,439,954 | 4/1984 | Bennett . |
| 4,600,149 | 7/1986 | Wakatsuki . |
| 4,727,687 | 8/1988 | Moore ..... 451/75 |
| 4,941,298 | 7/1990 | Fernwood et al. . |
| 4,986,475 | 1/1991 | Spadafora et al. . |

FOREIGN PATENT DOCUMENTS

| | | |
|---|---|---|
| 816893 | 10/1974 | Belgium . |
| 0110529 | 6/1984 | European Pat. Off. . |
| 0200858 | 11/1986 | European Pat. Off. . |
| 0384873 | 8/1990 | European Pat. Off. . |
| 418513 | 7/1910 | France . |
| 546037 | 1/1922 | France . |
| 1414659 | 11/1964 | France . |
| 1495083 | 9/1966 | France . |
| 2329407 | 5/1977 | France . |
| 2599772 | 12/1987 | France . |
| 2643673 | 6/1991 | France . |
| 2643626 | 9/1991 | France . |

(List continued on next page.)

OTHER PUBLICATIONS

Patent Abstracts of Japan, vol. 3, No. 7, 24 Jan. 1979 & JP–A–53132434 18 Nov. 1978.

Patent Abstracts of Japan, vol. 7, No. 189, 18 Aug. 1983 & JP–A–5809063 30 May 1983.

Patent Abstracts of Japan, vol. 9, No. 80, 10 Apr. 1985 & JP–A–59209768 28 Nov. 1984.

*Primary Examiner*—D. S. Meislin
*Assistant Examiner*—Derris Banks
*Attorney, Agent, or Firm*—Larson and Taylor

[57] ABSTRACT

In performing micro-cleaning and micro-blasting, a dry micro-cleaning abrasive powder is sprayed having a very small grain size. This enables high cleaning speeds to be reconciled with exceptionally fine blasting in order to remove dirty stains and encrusted deposits from valuable, delicate, or fragile medium as is the case when having to blast off pollutants and pollution that become stuck to the surfaces of monuments and buildings. Jets of compressed air charged with fine abrasive particles having grain sizes of less than 200 micrometers can also be sprayed towards the surface. The jets are emitted from nozzles at high speeds so that they sweep the surface with at least ten jets, each of which has a cross section lying in the range of 400 micrometers to 4 millimeters, so that very low kinetic energy is imparted to the surface.

17 Claims, 5 Drawing Sheets

U.S. PATENT DOCUMENTS

| | | |
|---|---|---|
| 2640529 | 12/1991 | France . |
| 1577563 | 1/1970 | Germany . |
| 2237021 | 1/1974 | Germany . |
| 8808550.3 | 12/1989 | Germany . |
| 8912741.2 | 2/1990 | Germany . |
| 3834896 | 4/1990 | Germany . |
| 9015670.6 | 3/1991 | Germany . |
| 64046 | 9/1949 | Netherlands . |
| 1151793 | 5/1969 | United Kingdom . |
| 2040193 | 8/1980 | United Kingdom . |
| 2065514 | 7/1981 | United Kingdom . |
| 2158749 | 11/1985 | United Kingdom . |

METHOD FOR MICRO-CLEANING A SUPPORT AND APPARATUS FOR IMPLEMENTING SAME

The present invention relates to a method of performing dry micro-cleaning by spraying abrasive powder having a very small grain size, the method enabling high cleaning speeds to be reconciled with exceptionally fine blasting.

There are numerous possible applications for the method of the invention. It is principally useful when various dirty stains and encrusted deposits are to be blasted off very finely from valuable, delicate, or fragile media.

In this way, a main application of the method of the invention is to blasting off pollutants and pollution that has become stuck to the surfaces of the outside faces of monuments and of buildings.

Industry releases numerous chemical pollutants into the atmosphere. Such pollutants (which comprise new types and new quantities of pollution) become stuck to the surfaces of the outside faces of monuments and of buildings, and they ultimately spoil the appearance of such monuments and buildings by gradually making them black and dirty.

Furthermore, in many cases, such pollution encrusted on the exposed stonework accelerates to a greater or lesser extent the degradation process of the stone used.

Under the action of such pollution, the surfaces of the exposed stonework of many monuments become weakened in a very non-uniform manner and to widely varying extents. Since the layer of pollution tends to become increasingly pellicular, it masks the weakened regions to a progressively increasing extent, thereby making the work of blast-cleaning the surfaces of such stone buildings an operation that is very fine and very fiddly.

Although exposed stonework has always been washed with water, today many scientists who are working on the problems of degradation in exposed stonework emphasize that cleaning off new pollutants by washing enables the pollutants to penetrate via capillary action, via joints that are faulty to various extents, or via surface points that have already been weakened, thereby contributing to accelerating the degradation process. Water, which in that case acts both as a chemical reagent and as a carrier of harmful salts, is becoming less and less suitable for cleaning off pollutants stuck to the surfaces of cut stone, especially if such surfaces have also been weakened (by flaking, pitting, etc.).

Unfortunately, in spite of the drawbacks of washing techniques using water, architects in charge of the upkeep and conservation of monument faces nevertheless hesitate to prefer cleaning by spraying abrasive particles, even fine particles, because of the risk (which varies in size) of subjecting the surface layer of the blast-cleaned stonework to abrasion.

In time, the surface layer of the cut stone used becomes covered with a fine crystallized layer that is harder than the inside of the stone and that protects the stone against external aggression of all kinds. The thickness of the fine protective layer varies in the range 2 millimeters to 5 millimeters, and such a layer forms a calcium-rich crust (or a sulfur-rich crust in an urban atmosphere). It is therefore essential to avoid subjecting the fine crystallized layer to abrasion if the stone is to be protected, especially since this fine film is progressively weakened under the action of pollution. In addition, such blackish pollution masks degraded regions and regions that are undergoing degradation, thereby making it difficult to see these weakened regions.

As a result, cleaning off pollution that has become encrusted on and stuck to cut stone surfaces is an operation that is becoming increasingly fiddly, requiring meticulous care and painstaking attention, and currently-used dry abrasive spraying techniques involve a risk of subjecting the material to abrasion and to aggression, which risk varies depending on the state, the hardness, and the uniformity of the hardness of the surface layer.

Sand-blasting is one of the basic abrasive spray techniques. It is very approximate, and very dusty, and it uses an arbitrary size of sand jet, which jet is fixed, unitary, and unidirectional, and is displaced manually by operators who are not necessarily meticulous and painstaking, and who work on the principle of maximum blasting productivity, and on the sand-blasting principle that black equals not blasted, and white equals blasted.

The principle of sand-blasting consists in spraying dry abrasives or sand having various degrees of coarseness or fineness under high air pressures (7 to $8\times10^5$ Pa on average) and via a blasting nozzle which is in the range 6 millimeters to 8 millimeters in section, and which is actuated manually by a sand-blasting operator.

Although the cleaning action obtained by such blasting is very effective and very fast, not only are copious amounts of dust given off, which is very unpleasant, but also the media, and in particular the molded portions and the sculptured portions thereof, are quite literally abraded. That is why all architects, contractors, etc. have had to stop using that blasting method which, although it is quick and cheap, is much too abrasive and causes too much inconvenience (dust), and they now much prefer washing and blasting techniques using water.

In attempts to overcome such drawbacks, in particular abrasion, various proposals have been made, the main proposal being to replace the excessively large volumes of sand with much finer sand, often having grain-sizes of less than 200 micrometers. In addition to such improvements, the architects in charge of the upkeep and conservation of ancient monuments require much finer blasting work, especially by the blasting operators.

Given the productivity requirements and the physical demands of the job, it is very difficult for the sand-blasting operators or drivers to perform regular, well-proportioned, and careful work for many consecutive hours. The productivity requirements of many contractors mean that the sand-blasting operators have to work at pressures that are too high (6, 7, 8, $10^5$ or even $12\times10$ Pa of pressure), that "blasting" jets (sand-blasting nozzles of 6 millimeters, 8 millimeters or even more) have to be used, and that very large volumes of air have to be sprayed, sometimes as much as 12,000 liters of air per minute, thereby giving rise to considerable abrasion even with very fine abrasive particles. Such abrasion damages all the delicate surface regions (sculptures, joints, the calcium-rich crust whose hardness is not uniform, etc.), not to mention the entire face, which may be quite literally abraded, even if the stone is hard, or the considerable amounts of dust given off, which means that the work space has to be sheeted off in a complicated and therefore costly manner.

In this way, the lack of care that results from having to meet the productivity requirements and the physical demands of the job increases to various extents the risk and the effect of abrasion of the cleaned media. Moreover, in view of the considerable risk of abrasion, it is impossible to use such "high-productivity" jets to clean valuable architectural media.

At the other end of the scale, so that the risk of abrasion is avoided entirely for valuable architectural media, and so as to guarantee that the media are blast-cleaned without being degraded in any way by abrasion, some restorers and some sculptors have gone to the opposite extreme by spraying air at only a very small flow-rate (a few tens of liters per minute), at extremely low pressures (a few hundreds of grams), via a nozzle that is as fine as possible (a spray "pen"), with the minimum possible amount of powder, and with the finest possible powder, i.e. often having a grain size of not more than 10 micrometers.

The thin stream of air obtained in this way is steered pen-like by the restorer who follows the relief of the small region being blasted, extremely patiently, millimeter by millimeter, and at a distance of 2 or 3 centimeters from the work face.

That micro-sandblasting technique, which can only be used by operators who are very patient, enables the blasting work to be performed with no real risk of abrasion, but the extreme slowness of that method prohibits it from being used on entire surfaces of buildings.

While the main particularity of the abrasive jet is that it blast-cleans approximately, and produces a considerable amount of dust which even makes it difficult to see the work, the sand-blasting jet blast-cleans mainly at its center of impact. Therefore, it can be understood that by reducing all the spraying parameters (air flow-rate, spraying pressure, abrasive grain-size, nozzle cross-section) as much as possible, as micro-sandblasting attempts to do, the center of impact mathematically blast-cleans and abrades less and less, and that by reducing all the air flow and abrasive flow parameters as much as possible, the work is made easier, while dust emission is limited to as little as possible.

But the absence of abrasive characteristics and of dust is achieved to the detriment of the cleaning speed and of the cutting characteristics required to obtain good cleaning. Since such a mini-jet lacks these cutting characteristics, it is not capable of cleaning certain types of encrusted dirt and stains, and it may even have the opposite effect and actually become abrasive because the regions that can no longer be cleaned since a mini-jet lacks any natural cutting characteristics need to be blasted for periods that are too long.

Therefore, an object of the present invention is to remedy all those drawbacks, and to this end, it provides:

a method of performing dry micro-cleaning and dry micro-blasting, the method enabling media to be blast-cleaned very quickly, even media that are very delicate and very fragile, as are cut stone media. millimeter, and at a distance of 2 or 3 centimeters from the work face.

That micro-sandblasting technique, which can only be used by operators who are very patient, enables the blasting work to be performed with no real risk of abrasion, but the extreme slowness of that method prohibits it from being used on entire surfaces of buildings.

While the main particularity of the abrasive jet is that it blast-cleans approximately, and produces a considerable amount of dust which even makes it difficult to see the work, the sand-blasting jet blast-cleans mainly at its center of impact. Therefore, it can be understood that by reducing all the spraying parameters (air flow-rate, spraying pressure, abrasive grain-size, nozzle cross-section) as much as possible, as micro-sandblasting attempts to do, the center of impact mathematically blast-cleans and abrades less and less, and that by reducing all the air flow and abrasive flow parameters as much as possible, the work is made easier, while dust emission is limited to as little as possible.

But the absence of abrasive characteristics and of dust is achieved to the detriment of the cleaning speed and of the cutting characteristics required to obtain good cleaning. Since such a mini-jet lacks these cutting characteristics, it is not capable of cleaning certain types of encrusted dirt and stains, and it may even have the opposite effect and actually become abrasive because the regions that can no longer be cleaned since a mini-jet lacks any natural cutting characteristics need to be blasted for periods that are too long.

Prior research work, in particular disclosed by published patents FR-B-2 640 529, FR-B-2 643 626, FR-B-2 643 673, and EP-B-0 384 873 filed by the Applicant, has revealed that by spraying an air-powder mixture against a support to be cleaned by means of a plurality of rotating nozzles, a good result is generally obtained.

Patent EP-B-0 384 873 indicates that a powder grain-size in the approximate range 100 micrometers to 200 micrometers is appropriate, and that two nozzles should be provided.

A similar technique is also described in prior document DE-U-90 15670. That technique uses four nozzles but does not specify the grain size of the abrasive particles, which are sand in that case.

None of the prior documents gives any indication of the through section via which the air-powder mixture passes through the nozzles.

Numerous tests conducted by the Applicant showed that that technique could be further improved with respect to effectiveness and productivity, in particular for treating certain types of pollution and certain media.

To this end, the Applicant initially considered increasing the through section of the nozzles, with a corresponding increase in the flow-rate of the air-powder mixture. That was not satisfactory because it gave rise to excessive blast-cleaning producing degradation of the treated surface, in particular on fragile and valuable architectural media, due to the high total kinetic energy of the streams sprayed.

Document DE-U-8 912 741 discloses a gun designed to spray a cleansing fluid against stone faces. That gun includes a fixed distributor member provided with a row of orifices through which the fluid can pass, the fluid not being specified.

Unfortunately, such apparatus is not suitable for cleaning and micro-blasting a medium effectively with an air-powder mixture, especially when the medium is fragile.

Therefore, an object of the present invention is to remedy all those drawbacks, and to this end, it provides:

a method of performing dry micro-cleaning and dry micro-blasting, the method enabling media to be blast-cleaned very quickly, even media that are very delicate and very fragile, as are cut stone media.

The method of the present invention enables blast-cleaning to be performed extremely rapidly while guaranteeing high-quality work, on all types of dirt and all types of media. The method of the invention guarantees that all cleaned media is entirely free of abrasion, even if the media locally include delicate regions and regions that are fragile to various extents, or more simply that have non-uniform surface hardness (masonry joints, flaking stone, non-uniform calcium-rich crusts, etc.). By means of the various possible combinations, the method of the present invention enables spraying to be performed without the inconvenience of dust.

The development of the method of the invention was based on the following observations:

in a unidirectional unitary fixed jet, since the center or "tip" of the jet is the cutting element that blast-cleans, it is therefore abrasive, and the parameters required to achieve fast blast-cleaning mean that the jet is as powerful a blast-cleaner as possible, thereby increasing the impact force of the tip of the jet accordingly, and therefore increasing the abrasion force and impact.

To avoid abrasion by the tip of the jet, the method of the invention is based on the principle that the spraying parameters must not be reduced, because such a reduction is achieved to the detriment of the speed and of the action of the blast-cleaning, but that to conserve the blast-cleaning speed and quality, the jet must be divided up into a multitude of or multiple fine micro-jets, and the multidirectionally angularly positioned multiple fine micro-jets must be displaced automatically and very rapidly.

For example, a jet from a nozzle having a cross-section of 8 millimeters may be divided up into 64 1 millimeter nozzles, 44 1.2 millimeter nozzles, 28 1.5 millimeter nozzles, or 12 2.5 millimeter nozzles etc. (the more the jet is divided, the finer the nozzles, and the more the effect is accentuated), thereby enabling maximum use to be made of the blast-cleaning action of the jet tips by multiplying their number while dividing their volume, and by distributing them over a certain area (the surface of a spraying disk or wheel).

The abrasive-spray nozzles for spraying abrasives are very fine, and they mainly lie in the range 1 millimeter to 2.5 millimeters (but in the principle of the invention, they may lie in the range 400 micrometers to 4 millimeters in section).

The very fine spray nozzles mean that only abrasives having very fine grain sizes (80 micrometers to 100 micrometers) may be used. Such very fine abrasives have almost no kinetic energy of their own, and they can be displaced at high speeds or at cleaning impact speeds only if they are conveyed in a jet or stream of compressed air. In this way, the jet or stream of compressed air serves as a protective guide for the very fine particles. The absence of kinetic energy of the very fine particles means that they are forced to stay within the streams of compressed air, and to comply strictly with the very fast displacement characteristics of the fine streams of air.

In this way, if the entire set of the multitude of or of the multiple nozzles are displaced at high speeds, they split the very fine streams of air charged with particles having very low kinetic energy into a multitude of short lengths of fine streams of air, thereby forming a mist of jet tips.

This multitude of jet tips, or very short lengths of fine streams of air, charged with very fine abrasives resulting from the fine streams of air being split mechanically, automatically, and continuously, sweep over the surface to be cleaned so as to brush thereover at high speeds, the sweeping then having neither the impact time nor the impact volume to be really abrasive in the direction in which the media being blasted is attacked.

The multiplicity of the jets and their displacement speed, together with the fineness of the nozzles and the fineness of the abrasives used then form a mist of micro-abrasive jet tips having "ultra-fast micro-pellicular highly-distributed impact", the mist only having the impact time and the impact force necessary to remove very quickly but very effectively the surface particles that are not bonded together, unlike the particles constituting cut stone.

The mist of jet tips then performs blast-cleaning by ultra-fast surface-brushing impact. The lack of impact volume and time, together with the continuous mechanical displacement of the jets divided up into multiple fine micro-jets spraying micro-fine particles enables very delicate and very fragile media to be blast-cleaned with fineness that is astonishing given the very high speeds of the blast-cleaning.

By multidirectionally angularly positioning the multiplicity of the nozzles spaced apart over a certain area, it is possible to have a multitude of different angles of attack. This, together with the continuous mechanical displacement of the micro-jets makes it possible to clean all the constituent points of a relief without having to dwell on certain regions by spraying them from all directions, and without having to turn the nozzle in all directions, and to follow the relief outlines of the surface being blasted insistently (abrasively), as is necessary with conventional unidirectional fixed jet techniques.

In this way, the method of the present invention is a method which consists firstly in spraying a micro-abrasive mist towards a medium to be cleaned and to be blasted, the mist being obtained by means of continuously and very rapidly displaced multiple fine streams of compressed air charged with abrasive particles having very low kinetic energy, and secondly in displacing the resulting micro-abrasive mist, over the entire length of the medium to be cleaned.

In preferred embodiments:

- the spraying device 21 is provided with multiple abrasive-spray nozzles 6 for spraying abrasives, the number of nozzles being about thirty on average (but exceeding one hundred in certain cases);
- each of said abrasive-spray nozzles 6 has a very fine section which mainly lies in the range 1 millimeter to 2.5 millimeters (but which may, in the principle of the method of the invention, lie in the range 400 micrometers to 4 millimeters);
- the abrasives sprayed by the multiple fine nozzles 6 are abrasives having very fine grain sizes that lie in the range 80 micrometers to 100 micrometers (but that may lie in the range 0 micrometer to 200 micrometers); the absence of kinetic energy of the very fine particles enables them to remain within the streams of compressed air and to comply with the very fast displacement characteristics of the fine streams of air; but the abrasives that have very fine grain sizes are very hard (glass grains or micro-balls, corundum, etc);
- the spraying device 21 is a spraying wheel 10, the spraying wheel 10 is a nozzle carrier, and it caps a wide funnel-shaped distribution cone 4;
- the distribution cone or funnel 4 and the wheel 10 are made of P.T.F.E. (Teflon) or of a ceramic; the nozzles 6 are made of ceramics; and
- when it is not bored and provided with nozzles 6, the spraying wheel 10 is provided with a multitude of or multiple fine orifices forming the nozzles 6 or a spraying system (the resulting assembly is then entirely made of a ceramic).

As a result of the very fine section of each pipe of each nozzle 6, the inside of each nozzle 6 is in the shape of a funnel 7. The cone or funnel shape 7 is necessary to enable the sprayed abrasives to flow easily and fluidly, because each pipe 8 of each nozzle 6 is very narrow.

The micro-abrasive mist is formed by displacing the nozzles 6 very rapidly. The wheel 10 carrying the nozzles 6 is rotated mechanically and automatically at various speeds lying mainly in the range 0 revolution per minute to 4,000 revolutions per minute.

This effect may be accentuated by other mechanical and automatic displacements, in particular by pivoting the wheel 10 about its own axis over a circular arc to the left, then over a circular arc to the right, then over an upward circular arc, and finally over a downward circular arc (the pivoting being mechanical and automatic about a support).

The entire set of mechanical displacements serve to increase the blast-cleaning speed of the micro-jets.

An object of the present invention is to avoid the abrasive impact produced by a single concentrated and very powerful unidirectional fixed jet (via an 8 millimeter nozzle) by using instead a multitude of or multiple fine multidirectional nozzles 6 (whose section lies in the range 400 micrometers to 4 millimeters), by spraying, under compressed air and via the fine nozzles 6, only abrasives having very fine grain sizes, mainly lying in the range 80 micrometers to 120 micrometers, and by displacing the fine nozzles 6 mechanically and at high speeds, thereby creating a mist of "jet tips" that attack multidirectionally and that are displaced continuously and very rapidly, so as to avoid the impact time, and so as to increase the blasting speed considerably.

By means of the fineness and multiplicity of the spray nozzles 6 (whose respective pipes 8 have sections mainly lying in the range 1 millimeter to 2.5 millimeters), by means of the relatively long spraying distance (in the range 20 centimeters to 80 centimeters from the medium being blast-cleaned), by means of the low kinetic energy of the sprayed abrasive particles (in the range 80 micrometers to 100 micrometers) enabling them to match the very fast displacement characteristics of the streams of air, by means of the very considerable attacking hardness of the very fine particles (glass grain, corundum, etc.), by means of the very high output speed imparted by the acceleration pipes 8 of the respective nozzles 6, by means of the large volume of air sprayed (several thousand liters per minute), and by means of the spraying pressure (3 to $6\times10^5$ Pa on average), together with the high speed mechanical displacements, the micro-abrasive mist formed under compressed air pressure is not a dust-producing mist, but rather it is a mist of "jet tips" which blast-clean by brushing over the surface being cleaned in a fast and continuous sweeping motion, thereby making it possible to combine very high blast-cleaning speeds with an absence of abrasion to the media being blast-cleaned, even if such media are very delicate, as are ancient buildings and monuments made of cut stone.

The method of the present invention for spraying fine abrasives under compressed air gives rise to various amounts of dust, although given its particularities (very fine nozzles 6), the method consumes two to three times less abrasive for the same effectiveness, and although each fine stream of air is set so as to spray a minimum amount of abrasive for a large volume of air, since it passes many times over the same points.

In the method of the invention, since the jets are fine and dispersed over the relatively large area of the surface 15 of a spraying wheel so as to spray the micro-abrasive mist, which is a source of dust, it is possible either:

- to position nozzles 14 for spraying atomized water in the spaces between the abrasive-spray nozzles 6. To obtain the same result over a conventional wide unidirectional abrasive-spray jet (an 8 millimeter nozzle), a lot of water would have to be sprayed simultaneously, and the force and the volume of the jet(s) of water would wet the wall at least to some extent, whereas, in the method of the invention, by dividing up the abrasive jet into multiple micro-jets, (e.g. an 8 millimeter nozzle-section jet may be divided up into 28 1.5 millimeter nozzles 6), 28 times less water is necessary per stream to be moistened, given that, in addition, the streams of air are set so as to consume very small amounts of abrasive. As a result, by spraying particles of atomized water under compressed air pressure instead of a jet of water, it is possible to moisten the abrasive particles without really wetting the jets. The jets of atomized water sprayed from the pneumatic atomization nozzles 14 are preferably directed in parallel with the abrasive jets; or
- to position a large number of very fine nozzles 17 for spraying fine jets of steam in the spaces between the abrasive-spray nozzles 6.

The method of the invention uses compressed air from a compressor, and forms the air-abrasive mixture by passing the air and abrasive through a sand-blaster. In the method of the invention, it is particularly advantageous not to use a sand-blaster. In this way, the compressed air from the compressor is sent directly and on its own to the multi-nozzle spraying device. The compressed air being mixed with the abrasive inside the spraying device 21 just before the outlet of each nozzle 6. This system enhances the method of the present invention by making better use of the nozzles which are as fine as possible, by considerably facilitating the regularity of the abrasive flow and flow-rate, and by consuming very small amounts of abrasive. As a result the jets are more regular and they may contain very small amounts of abrasive.

Other characteristics and advantages of the invention appear from the following description of preferred embodiments of the invention given with reference to the accompanying drawings, in which.

Figure 1:
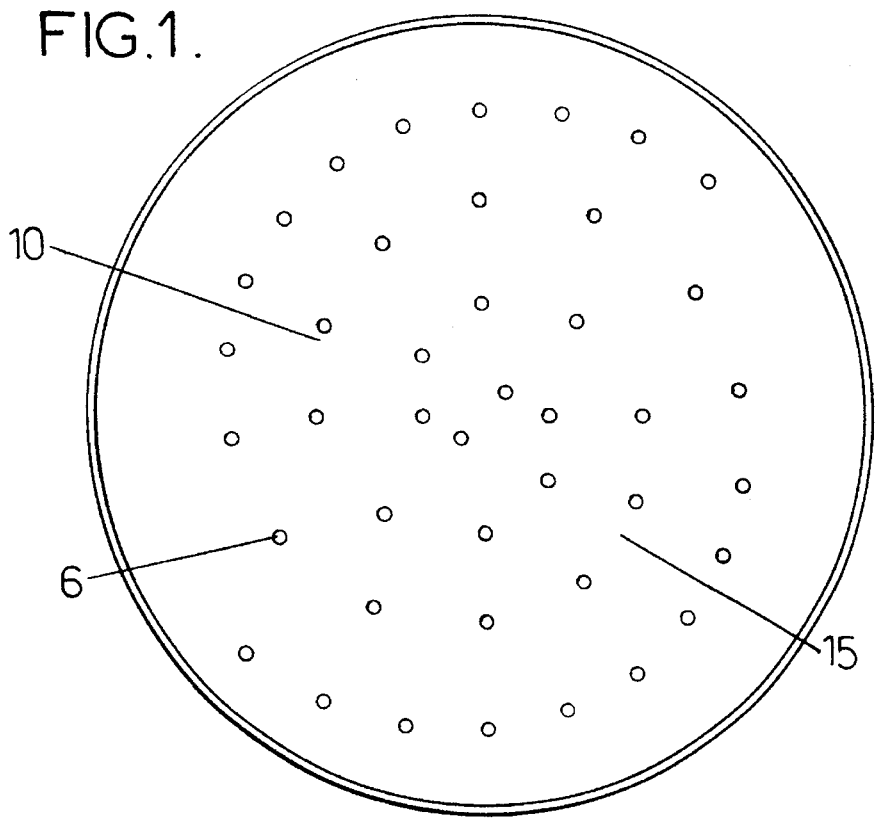
FIG. 1 is a diagrammatic view of the spraying face of a wheel provided with 42 nozzles for spraying abrasives.
Figure 2:
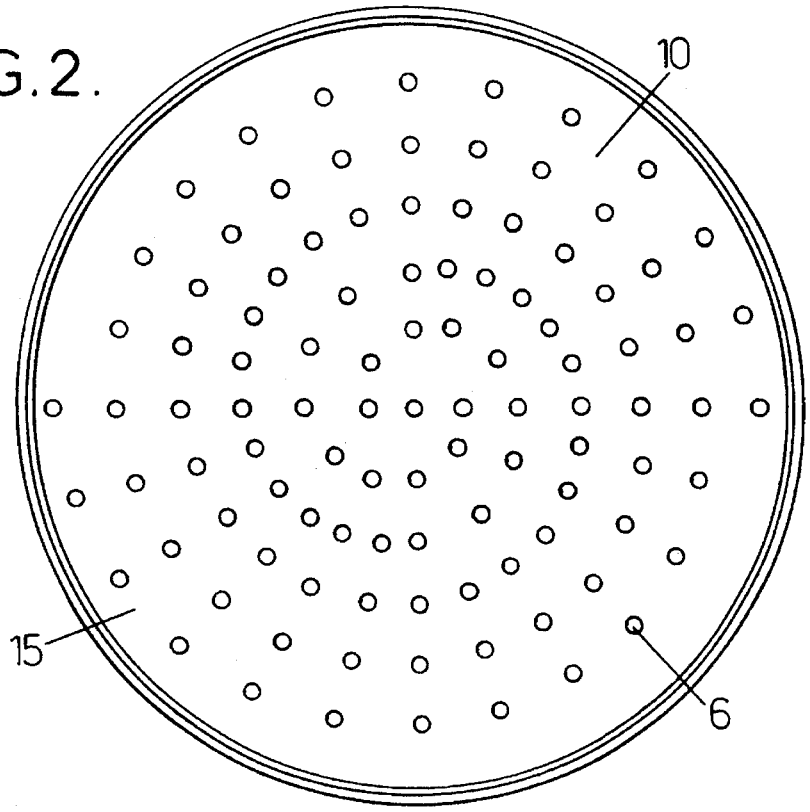
FIG. 2 is a diagrammatic view of the spraying face of a wheel provided with 132 nozzles for spraying abrasives.
Figure 3:
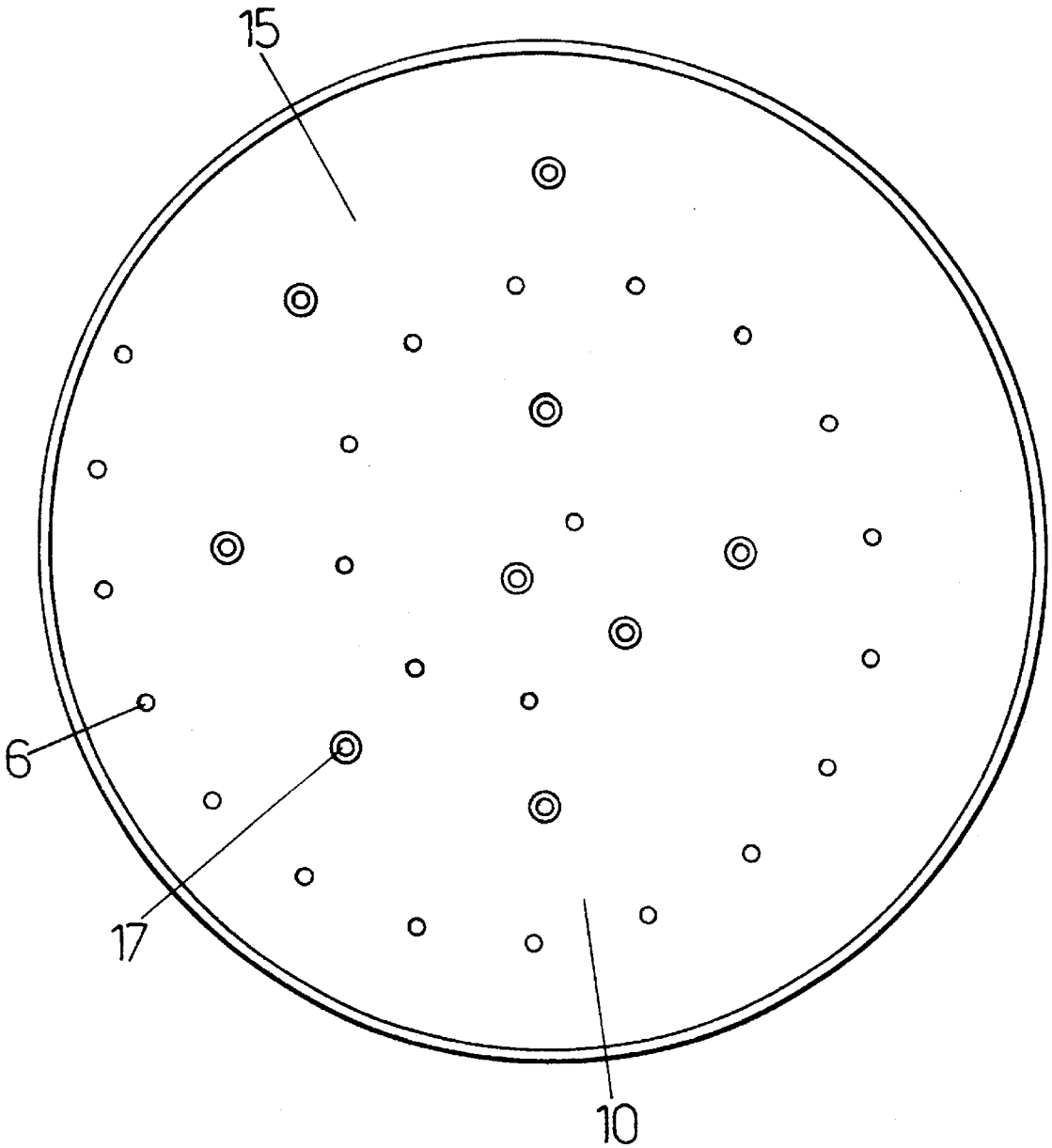
FIG. 3 is a diagrammatic view of a spraying wheel provided with nozzles for spraying abrasives and nozzles for spraying fine jets of steam.
Figure 4:
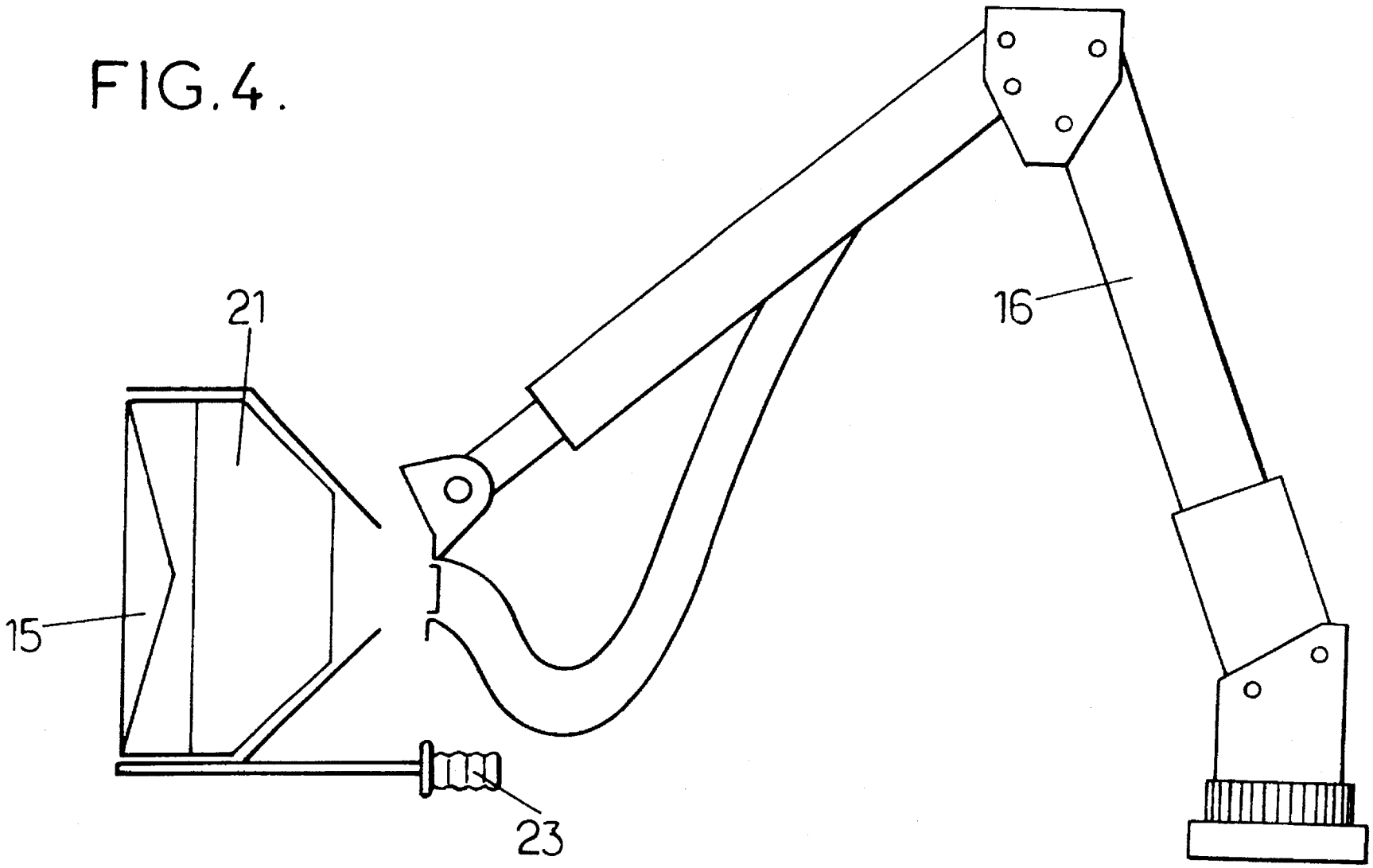
FIG. 4 is a diagrammatic view of the spraying device 21 mounted on a positioning and support arm.
Figure 5:
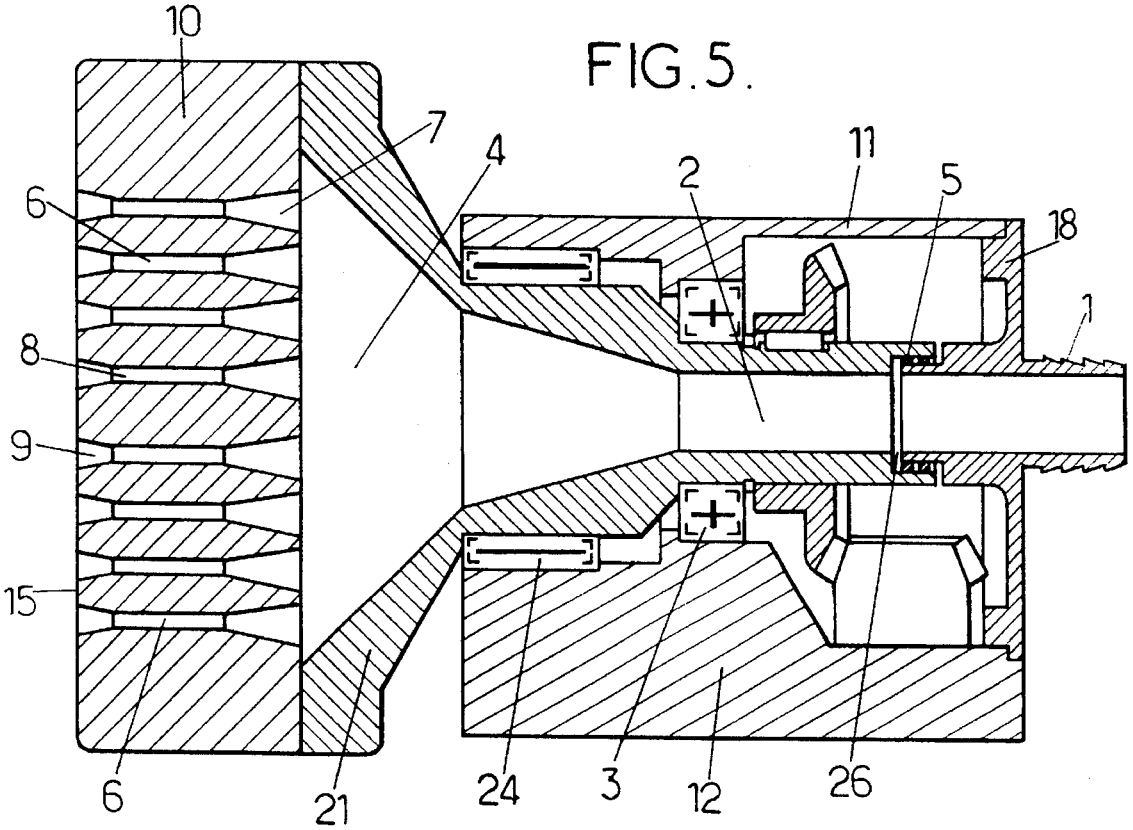
FIG. 5 is a diagrammatic section view of the mechanical spraying wheel provided with nozzles for spraying abrasives.
Figure 6:
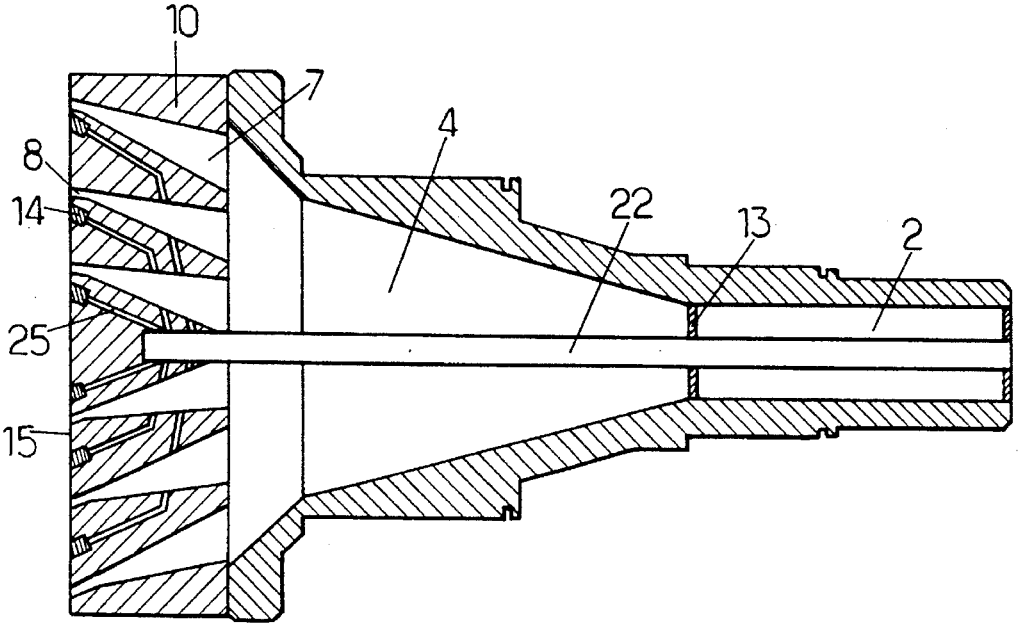
FIG. 6 is a diagram showing how the water-atomization nozzles are fed.
Figure 7:
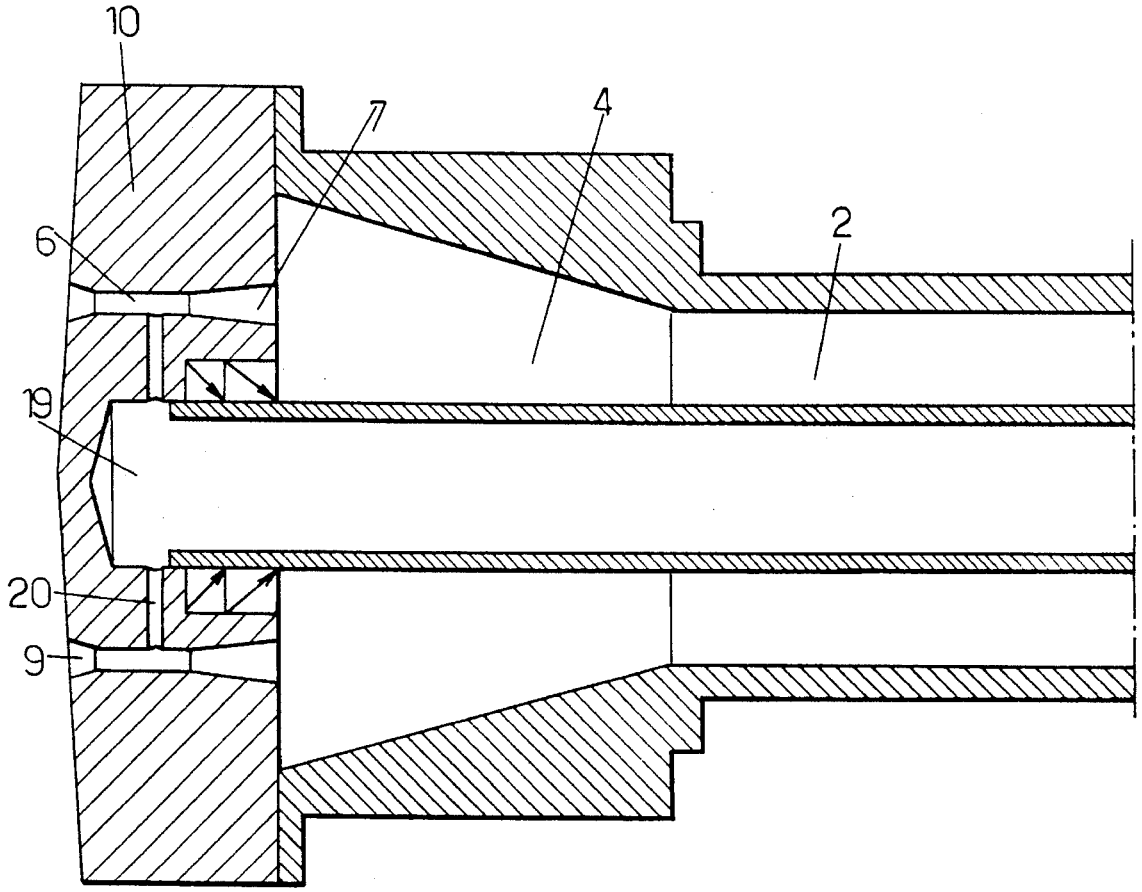
FIG. 7 is a diagram showing a spraying device provided with an air-abrasive mixing system inside the device, the system sucking in abrasive particles just before they are sprayed.

The apparatus for implementing the method of the invention comprises a spraying device or spraying wheel comprising the following in the direction in which the abrasive particles are displaced: a cylindrical feed tube 2 for feeding in the air-abrasive particle mixture, the tube opening out into a wide funnel-shaped flared portion 4 communicating via inlet cones 7 with said nozzles 6 for spraying abrasives, the direction of each of the nozzles 6 forming an acute angle with the longitudinal axis of said feed tube 2. Having a different angle of inclination for each nozzle 6 enables a multitude of different spraying angles to be obtained, thereby providing spraying by means of multidirectional micro-jets.

The spraying wheel or device 21 is provided with a multitude of or with multiple fine abrasive-spray nozzles 6 for spraying abrasives, the nozzles being positioned and spaced apart on a spraying disk 15. The nozzles are positioned in mainly spiral patterns so as to accentuate the rotary effect and so as to cover and sweep as many different cleaning points as possible. The numerous abrasive-spray nozzles 6 do not project or hardly project from the spraying face 15, thereby providing a very compact assembly, and enabling the spraying device 21 to be displaced through the air very reliably, and in all directions, even at very high displacement speeds.

The spraying wheel 10 is provided with means and motorized means enabling it to be mechanically rotated at very high speeds (in the range 0 revolution per minute to 4,000 revolutions per minute).

The spraying wheel 10 is provided with means and motorized means enabling it to be pivoted about its own axis mechanically and automatically over strokes respectively covering a circular arc to the left and a circular arc to the right.

The spraying wheel 10 is provided with means and motorized means enabling it to be pivoted about its own axis mechanically and automatically over strokes respectively covering a circular arc upwards and a circular arc downwards.

The spraying wheel 10 is provided with means making it possible to modify all the spraying parameters automatically (on, off, mechanical speed variation, flow-rate, pressure, air to abrasive ratio, etc.).

The spraying wheel or device 10 is provided with a system for distributing and spraying the air-abrasive mixture. The system comprises:

- a fixed feed pipe 1 for feeding in the air-abrasive mixture;
- a cylindrical feed tube 2 for feeding in the air-abrasive mixture, the entire tube 2 being rotatably mounted via a set of two-seal bearings 3;
- a central bore 4 forming a wide funnel-shaped flared portion enabling all the abrasive-spray nozzles 6 to be fed via the dispensing and distribution cones 4, thereby dividing up the central jet into a multitude of micro-jets. The bore 4 opens out and branches out into the nozzle inlet cones 7 which are also funnel-shaped and situated in the spraying wheel 10; and
- spray nozzles 6: the wheel 10 carrying the nozzles 6 is made of a ceramic, it is provided with a multitude of or with multiple fine multidirectional orifices forming the nozzles 6 for spraying fine abrasives.

Each nozzle 6 of the wheel 10 comprises:

- a very wide funnel-shaped nozzle inlet cone 7 enabling the particles to flow fluidly and easily as a result of the jet being divided up into a multitude of very fine jets, and as a result of the narrowness of the resulting pipes;
- an acceleration pipe 8 for accelerating the air and the abrasive particles; and
- an ejection pipe 9 whose cross-section varies along its main direction from a circular shape to an oblong shape at its outlet opening in the particle-spraying face 15.

The entire spraying wheel 10 is mounted inside a completely sealed casing 11. Providing rotating mechanical parts in surroundings containing very fine abrasives (with certain abrasive particles being no larger than a few microns) requires a specific design configuration, and sealing that is specifically designed to cope with the fineness of such very fine abrasives.

The device is completely sealed by means of the following:

- a recessed joint 26 via which the fixed portion is received in the moving portion, the moving portion being guided in rotation such that it is sealed by rotary gaskets 5 of the lip seal type, and the feed cone 4 is guided in rotation relative to the fixed casing 11 via two-seal bearings 3, the rear cover 18 being sealed by a flat gasket.

With the principle of working without a sand-blaster, the configuration of the inside of the spraying device 21 is modified in that:

- a central feed pipe 19 for feeding in the abrasive (by suction) branches out into as many small ducts 20 (for supplying abrasives) as there are nozzles 6. The air on its own (not containing abrasives) that arrives in the nozzle inlet cones 7 sucks in a small quantity of abrasive regularly and simultaneously as it goes past. The central feed pipe 19 for feeding in abrasive (by suction) is fixed relative to the air feed cone, and it is centered and fixed via fixing tabs connected to the rotary tube 2 and to the distribution cone 4. In this way, the central feed pipe is rotated simultaneously with the tube 2 and with the distribution cone 4, and it is therefore provided with a sealed rotary gasket at the join where it meets the duct for feeding in the abrasive.

The abrasive spray produced by this spraying wheel in the form of mist gives rise to high amounts of dust. Therefore, in addition to spraying fine streams of air containing very fine abrasive particles, it is advantageous to provide the abrasive-spraying wheel 10 with a certain number of very fine nozzles 14 for spraying atomized water, or with a certain number of very fine nozzles 17 for spraying very fine jets of steam.

By using fine streams of air and of abrasives, for which the spray nozzles 6 are disposed over the relatively large area constituted by the surface 15 of the spraying wheel 10, it is possible to dilute the streams of compressed air and of abrasives in a mist of atomized water particles. By rotating, the spraying wheel 10 also homogenizes the mist of water which re-forms continuously in the gaps in the abrasive spray.

The very fine particles of atomized water sprayed into the spraying space, are sprayed in the form of extremely fine particles of atomized water, the grain-size of the particles of atomized water being as fine as possible.

In this way, the spraying wheel 10 is provided with nozzles 14 for spraying atomized water, which nozzles are disposed in the spraying face 15. The water is fed into the spraying device via a duct 22 that is fixed and centered inside the cone for feeding in the air-abrasive mixture. This pipe 22 is fixed via fixing tabs 13 connected to the rotary tube 2 and to the distribution cone 4. The pipe 22 is rotated simultaneously with the tube 2 and with the distribution cone 4, and it therefore requires a rotary sealing gasket sealed to the duct 22 for feeding in water under pressure. The pipe 22 branches out into a series of small channels 25 that direct the water to the atomization nozzles 14.

The jets of atomized water sprayed via the pneumatic atomization nozzles are adjusted so as to project clouds of atomized water, and the jets from nozzles 14 are preferably directed in parallel with the jets of abrasives.

In different embodiments, the nozzles 14 for spraying atomized water may be replaced by nozzles 17 for spraying very fine jets of steam.

The wheel 10 for projecting very fine abrasives may have a diameter lying in the range a few centimeters to several tens of centimeters. The diameter of the spraying wheel 10 is proportional to the number of nozzles with which it is provided, and to the spacing therebetween.

The method of the invention is a micro-blasting and micro-cleaning method combining speed and very high quality. This high-speed surface-brushing impact method may be applied to nearly all types of media, in particular delicate and very fragile media (old stone, degraded and flaking stone, antiques, old furniture, plaster, etc.), and it enables all types of stains and deposits to be cleaned off (hydrocarbons, various types of pollution, tags, graffiti, etc.).

In a preferred embodiment of the spraying wheel or device 21, the spraying device 21 is mounted on a support and positioning arm 16. The device is provided with guide and displacement handles 23. The spraying wheel 10 is provided with forty-eight nozzles 6 for spraying fine abrasives. The cross-section of each of the nozzles is 2 millimeters. The nozzles are made of a ceramic. In the direction in which the particles are displaced, the assembly comprises:

a feed tube 2 for feeding in the air-abrasive particle mixture, the tube opening out into a wide funnel-shaped flared portion 4, the flared portion communicating via inlet cones 7 with said nozzles 6 for spraying abrasives, the direction of each of said nozzles forming an acute angle with the longitudinal axis of said feed tube 2.

The feed cone 4 which feeds the abrasive into the wheel 10 carrying the nozzles 6 is made of P.T.F.E (Teflon), it is guided in rotation by a sealed needle bushing 24 and by a sealed ball bearing 3, received in a casing 11 which is itself sealed. The rotary drive is provided by a pneumatic motor 12. The rotary guide means are sealed to the duct for feeding in air-plus-abrasive by a two-seal rotary gasket. To make dust-free operation possible, the device is provided with a set of 24 nozzles 14 for spraying air-plus-atomized water.

The compressed air is supplied by a compressor, the air-plus-abrasive mixture being produced by means of a sand-blaster. The air-abrasive mixture arrives via the fixed tube 1. The air-water mixture is supplied by means of a water compressor and supercharger.

The operator takes up a position facing the surface to be blasted, and positions the spraying device so that it faces that region. The operator then starts the rotary motor, switches on the air-water mixture, switches on the air-abrasive mixture, and starts to displace the device gradually, and substantially parallel to the surface to be blasted. There is no impact point since the very numerous jets are displaced at very high speed over the region being blasted, thereby sweeping the surface of said region gently (but effectively) with a micro-abrasive mist. The presence of delicate or fragile points in this region does not in any way modify the settings or the working speed of the device. In this way, the device enables a region to be cleaned very quickly without there being any risk of abrading or degrading the blasted surface. The mist of water particles sprayed simultaneously moistens the dust without wetting the jets, thereby enabling the blasting work to be very fine, fast, and dust-free.

I claim:

1. A method of micro-cleaning and of micro-blasting a support comprising the steps of: spraying towards the support a multitude of jets of compressed air charged with fine abrasive particles having grain sizes which lie mainly in the range 80 micrometers to 120 micrometers, the spraying step including the emitting of the jets via nozzles, and the displacing at high speeds of the jets to sweep the support with the jets, wherein the multitude of jets is at least ten, and wherein, at each nozzle, the respective jet has a cross-section lying in the range 400 micrometers to 4 millimeters, thereby imparting very low kinetic energy to each jet.

2. A method of micro-cleaning and of micro-blasting a support comprising the steps of: spraying towards the support a multitude of jets of compressed air charged with fine abrasive particles having grain sizes of less than 200 micrometers, the spraying step including the emitting of the jets via nozzles and the displacing of the jets at high speeds so that the jets sweep the support, wherein the emitting step includes the dividing up of a single main jet, into at least ten jets, and wherein, at each nozzle, the respective jet has a cross-section lying in the range 400 micrometers to 4 millimeters, thereby imparting very low kinetic energy to the jet.

3. A method according to claim 2, and further comprising the step of spraying a mist of atomized water particles simultaneously with said jets.

4. A method according to claim 2, and further comprising the steps of reaching said fine abrasive particles into said compressed air just upstream of said nozzles.

5. A method according to claim 2, and further including the step of spraying a mist of fine jets of steam simultaneously with said jets of compressed air charged with abrasive particles.

6. Micro-cleaning and micro-blasting apparatus comprising: a spraying device, a fixing support on which said spraying device is mounted, and a means for pivoting said spraying device relative to said fixing support, said spraying device including a rotary wheel having a spraying face provided with nozzles for spraying compressed air charged with fine abrasive particles, wherein said rotary wheel includes a multitude of at least ten of said nozzles, and each said nozzle has an inlet cone and a through section lying in the range 400 micrometers to 4 millimeters through which the particles can pass.

7. Micro-cleaning and micro-blasting apparatus comprising a spraying device including a rotary wheel having a spraying face provided with nozzles for spraying compressed air charged with fine abrasive particles, wherein said rotary wheel includes a multitude of at least ten of said nozzles, and each said nozzle has an inlet cone and a through section lying in the range of 1 millimeter to 2.5 millimeters through which the particles can pass.

8. Apparatus according to claim 7, wherein the wheel is provided with ten to several tens of nozzles.

9. Apparatus according to claim 7, wherein the wheel is provided with several tens of to several hundreds of nozzles.

10. Apparatus according to claim 7, wherein said nozzles are disposed at different multidirectional spraying angles.

11. Apparatus according to claim 7, wherein the spraying device is also provided with nozzles for spraying a mixture of compressed air and water.

12. Apparatus according to claim 7, wherein said nozzles do not project substantially from the spraying face of the wheel.

13. Apparatus according to claim 7, wherein, in a direction in which the abrasive particles are displaced, the device includes a feed tube for feeding in the compressed air charged with fine abrasive particles, said tube opening out into a funnel-shaped flared portion.

14. Apparatus according to claim 13, wherein said flared portion communicates with said nozzles, and where said tube has a longitudinal axis and each of said nozzles forms an acute angle with the longitudinal axis of said feed tube.

15. Micro-cleaning and micro-blasting apparatus comprising a spraying device including a rotary wheel having a spraying face provided with a multitude of nozzles, said nozzles including air nozzles for spraying compressed air charged with fine abrasive particles and steam nozzles for spraying fine jets of steam, the multitude of said nozzles being at least ten of said nozzles, and each said nozzle having an inlet cone and a through section lying in the range 400 micrometers to 4 millimeters through which the particles can pass.

16. Micro-cleaning and micro-blasting apparatus comprising a spraying device including a rotary wheel having a spraying face provided with nozzles for spraying compressed air charged with fine abrasive particles, wherein said rotary wheel includes a multitude of at least ten of said nozzles, and each said nozzle has an inlet cone and a through section lying in the range 400 micrometers to 4 millimeters through which the particles can pass, and wherein the abrasive is sucked in the compressed air via an independent pipe and said independent pipe passes through a feed tube and a flared portion.

17. Apparatus according to claim 16 wherein said feed tube is a rotary pipe to which said compressed air charged with abrasive particles is fed via a fixed tube, said rotary pipe being secured to said wheel, a sealing between the fixed tube and the rotary pipe being provided by a recessed joint via which the fixed tube is received in the rotary pipe, with rotary gaskets having the lip seal being provided in said joint.

* * * * *